US010653239B2

(12) United States Patent
Nilsson et al.

(10) Patent No.: US 10,653,239 B2
(45) Date of Patent: May 19, 2020

(54) SUSPENSION SYSTEM

(71) Applicant: Elfa International AB, Västervik (SE)

(72) Inventors: Peter Nilsson, Västervik (SE); Lars Ryden, Västervik (SE)

(73) Assignee: Elfa International AB, Vastervik (SE)

( * ) Notice: Subject to any disclaimer, the term of this patent is extended or adjusted under 35 U.S.C. 154(b) by 45 days.

(21) Appl. No.: 16/090,266

(22) PCT Filed: Mar. 30, 2017

(86) PCT No.: PCT/SE2017/050308
§ 371 (c)(1),
(2) Date: Sep. 30, 2018

(87) PCT Pub. No.: WO2017/171618
PCT Pub. Date: Oct. 5, 2017

(65) Prior Publication Data

US 2019/0110593 A1 Apr. 18, 2019

(30) Foreign Application Priority Data

Mar. 31, 2016 (SE) ..... 1650418

(51) Int. Cl.
*A47B 57/42* (2006.01)
*A47F 5/00* (2006.01)
(Continued)

(52) U.S. Cl.
CPC ..... *A47B 57/42* (2013.01); *A47B 96/028* (2013.01); *A47F 5/0093* (2013.01); *A47B 88/43* (2017.01); *A47F 5/103* (2013.01)

(58) Field of Classification Search
CPC ..... A47B 57/42; A47B 96/061; A47B 96/06; A47B 96/028; A47B 88/43; A47F 5/0093; A47F 5/103
See application file for complete search history.

(56) References Cited

U.S. PATENT DOCUMENTS 3,572,626 A * 3/1971 Bertschi ..... A47B 57/045 248/242
3,965,826 A * 6/1976 Markham ..... A47B 57/42 108/152
(Continued)

FOREIGN PATENT DOCUMENTS

WO 03034867 A2 5/2003

OTHER PUBLICATIONS

International Search Report and Written Opinion received in Patent Cooperation Treaty Application No. PCT/SE2017/050308, dated Jun. 20, 2017, 12 pages.

*Primary Examiner* — Patrick D Hawn
(74) *Attorney, Agent, or Firm* — Hubbard Johnston, PLLC

(57) ABSTRACT

The present disclosure relates to a suspension system (1) comprising first and second support elements (3), configured to be vertically arranged, and first and second brackets (5), which are attached to a respective one of the support elements in a cantilevered fashion. The system further includes a frame (7, 27), with side portions (27) that are attached to a respective one of the brackets by means of fastening arrangements, such that the frame with a container attached thereto becomes slidable as a drawer. Each fastening arrangement has a mid-section attachment device including a centre cut-out (19) in the mid third of the bracket, an attachment tongue (23) on the side portion (27), which is configured to be inserted into the centre cut-out to clasp its edge, and a bulb (25) which snaps into the cut-out, and a front attachment device with a front cut-out (17) in the bracket, a front attachment tongue (31) on the side portion, which is configured to be inserted into the front cut-out to clasp its edge, and a support tongue (33) which abuts the lower art of the bracket, such that a nose portion (37) of the
(Continued)

bracket is wedged in between the front attachment tongue and the support tongue.

15 Claims, 3 Drawing Sheets

(51) Int. Cl.
*A47B 96/02* (2006.01)
*A47F 5/10* (2006.01)
*A47B 88/43* (2017.01)

(56) References Cited

U.S. PATENT DOCUMENTS 4,720,069 A * 1/1988 Bessinger ..... A47B 96/061 211/90.01
5,205,524 A * 4/1993 Cohen ..... A47B 57/06 211/103
5,297,486 A * 3/1994 Herrmann ..... A47B 96/028 108/108
5,346,077 A * 9/1994 Randall ..... A47B 75/00 211/134
5,351,842 A * 10/1994 Remmers ..... A47B 96/028 108/152
5,592,886 A 1/1997 Williams et al.
6,019,331 A * 2/2000 Hoogland ..... A47B 96/061 108/108
6,024,333 A * 2/2000 Raasch ..... A47B 55/02 211/134
6,082,690 A * 7/2000 Durin ..... H02G 3/263 211/90.01
6,345,579 B1 * 2/2002 Zaturensky ..... A47B 96/028 108/108
6,402,108 B1 * 6/2002 Remmers ..... A47B 57/42 211/181.1
D461,657 S * 8/2002 Magnusson ..... D8/381
6,969,036 B2 * 11/2005 Magnusson ..... A47B 96/02 248/339
6,978,975 B1 * 12/2005 Magnusson ..... A47B 96/028 248/249
7,086,544 B1 * 8/2006 Doench ..... A47B 61/003 211/105.1
7,104,411 B2 * 9/2006 Magnusson ..... A47B 96/028 211/90.01
7,243,887 B2 * 7/2007 Magnusson ..... A47B 96/024 248/235
7,300,122 B2 * 11/2007 Vardon ..... A47B 96/021 312/408
7,497,344 B2 * 3/2009 Chen ..... A47B 57/40 108/108
8,550,259 B1 * 10/2013 McCoy ..... H02G 3/30 211/13.1
9,173,506 B2 * 11/2015 Andersson ..... A47B 57/42
9,277,814 B2 * 3/2016 Winker ..... A47B 87/005
10,426,262 B2 * 10/2019 Robinson ..... A47B 57/487
2004/0020884 A1 * 2/2004 Magnusson ..... A47B 96/028 211/90.01
2007/0221597 A1 9/2007 Chen
2007/0241072 A1 * 10/2007 Bryant ..... A47B 96/021 211/90.02
2007/0262037 A1 * 11/2007 Cheng ..... A47B 57/482 211/103

* cited by examiner

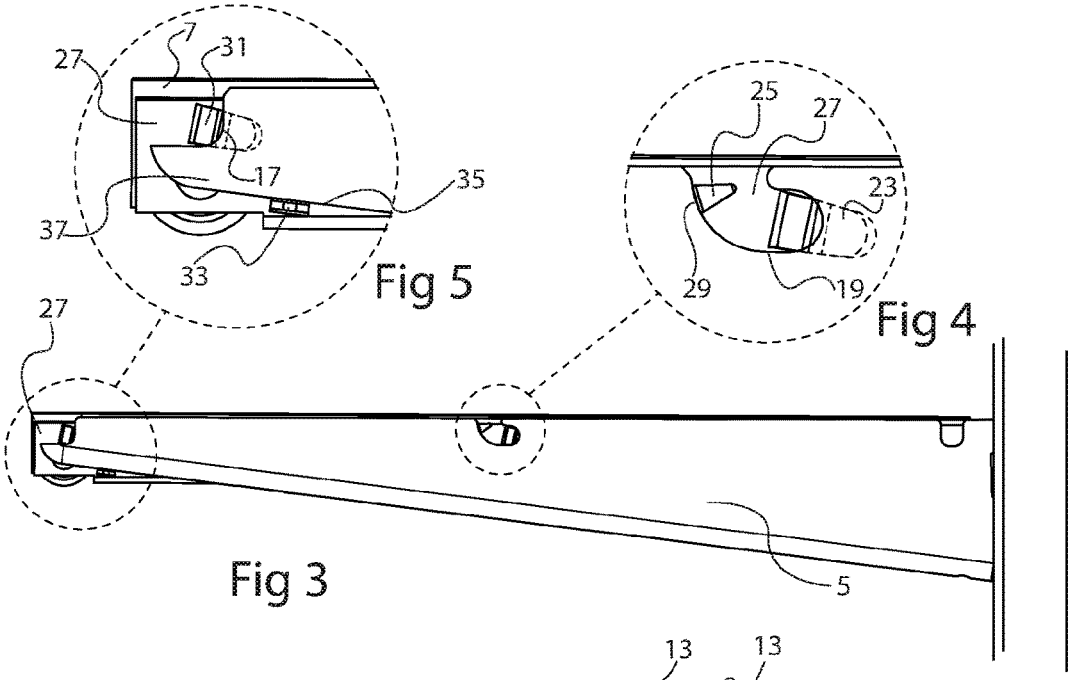
27
7
31
17
35
37
33
Fig 5
25
27
23
29
19
Fig 4
27
5
Fig 3
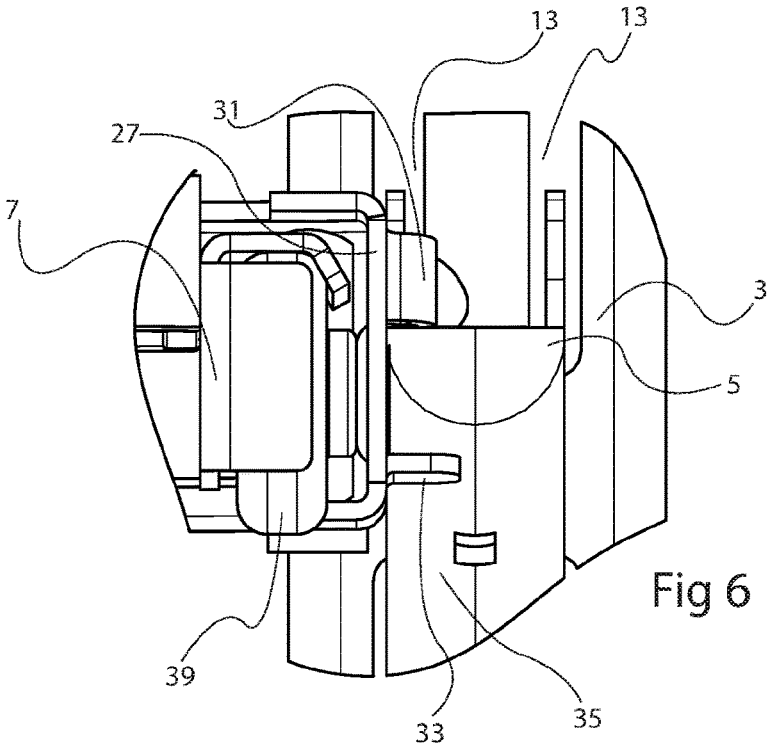
13
13
31
27
7
3
5
39
33
35
Fig 6
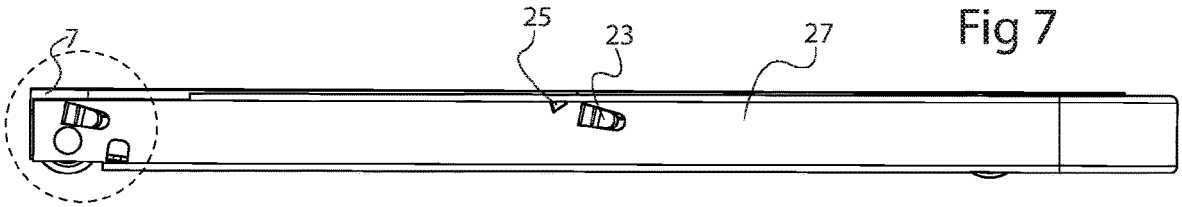
7
25
23
27
Fig 7

SUSPENSION SYSTEM

RELATED APPLICATION

This application is a national phase application of PCT/SE2017/050308, filed Mar. 30, 2017 and claims priority to Swedish Application No. 1650418-5 filed Mar. 31, 2016.

TECHNICAL FIELD

The present disclosure relates to a suspension system comprising first and second support elements, configured to be vertically arranged, and first and second brackets, each configured to be attached to a respective one of the support elements in a cantilevered fashion. The bracket has a U-shaped cross-section with first and second leg portions and an interconnecting lower bend portion. A frame comprises side portions, each being configured to be attached to a respective one of the brackets by means of a fastening arrangement at each bracket. A guided part of the frame is slidable in and out of an area in between the brackets and may comprise a holding device such as a container.

BACKGROUND

Such a system is disclosed in U.S. Pat. No. 7,104,411 B2. That system allows an end user to assemble a drawer by attaching two brackets to a respective support element. A frame is attached to the brackets, and a container, for instance a wire basket, is fitted in the frame. The frame comprises side parts attached to the brackets and a container holding part which is slidable with respect to the side parts. Thereby a drawer is accomplished. One problem associated with such devices is how to accomplish a reliable attachment of the side parts to the brackets that can be readily fastened by an end user.

SUMMARY

One object of the present disclosure is therefore to accomplish a suspension system with a reliable fastening arrangement that is easy to use. This object is achieved by means of a suspension system as defined in claim 1. More specifically, in a system of the initially mentioned kind, the fastening arrangement comprises the combination of a mid-section attachment device including a centre cut-out in the mid third of the bracket and in a leg portion thereof, a centre attachment tongue on the frame side portion, which is configured to be inserted into the centre cut-out to clasp the edge thereof, and a bulb adapted to snap into the centre cut-out, and a front attachment device including a front cut-out in the cantilevered end of the bracket, in a leg portion thereof, a front attachment tongue on the frame side portion, which is configured to be inserted into the front cut-out to clasp the edge thereof, and a support tongue configured to abut the lower portion of the bracket, such that a nose portion of the bracket is wedged in between the front attachment tongue and the support tongue. Thanks to this arrangement, the frame side portion at each side can be suspended from the bracket only by means of the centre attachment tongue, the front attachment tongue and the support tongue. The user only need to fit the front and centre attachment tongues correctly with respect to their respective cut-outs, and snap the side portion into attachment with the frame. Thanks to the relatively short distance in between the front tongue and the support tongue, tolerances can be kept relatively small as compared to a case where instead a rear tongue would be used.

The front cut-out may comprise a rear vertical portion, a front horizontal portion and a radius in between the vertical and horizontal portions, and the front attachment tongue may rest on the front cut-out at the transition between the horizontal portion and the radius when the frame is attached to the bracket. This means that a precise very gentle wedging effect on the nose portion will take place when the frame is fitted, which means that a low attachment force is needed.

The support tongue may be configured to abut the lower portion of the bracket at the interconnecting bend portion at a point on the bend portion located at the same lateral half of the bracket as the front cut-out. This means that an identical frame can be attached also to the other lateral side of the bracket.

The front tongue may have an attachment line, where it is connected to the fixed part of the frame, wherein the attachment line forms an acute angle in the range 75-82 degrees with the longitudinal direction of the frame, and the support tongue may have an attachment line, where it is connected to the fixed part of the frame, wherein the attachment line forms an angle in the range 5-9 degrees with the longitudinal direction of the frame. This configuration facilitates fastening to the bracket.

BRIEF DESCRIPTION OF THE DRAWINGS

FIG. 3 shows the side view of FIG. 2 when a side portion of a frame is attached to the bracket.

FIGS. 4 and 5 show enlarged portions of FIG. 3.

FIG. 6 shows a front view of a bracket attached to a carrier and wherein a frame is attached to the bracket, as seen from the cantilevered front end of the bracket.

FIG. 7 shows a side view of a frame.

DETAILED DESCRIPTION

Figure 1:
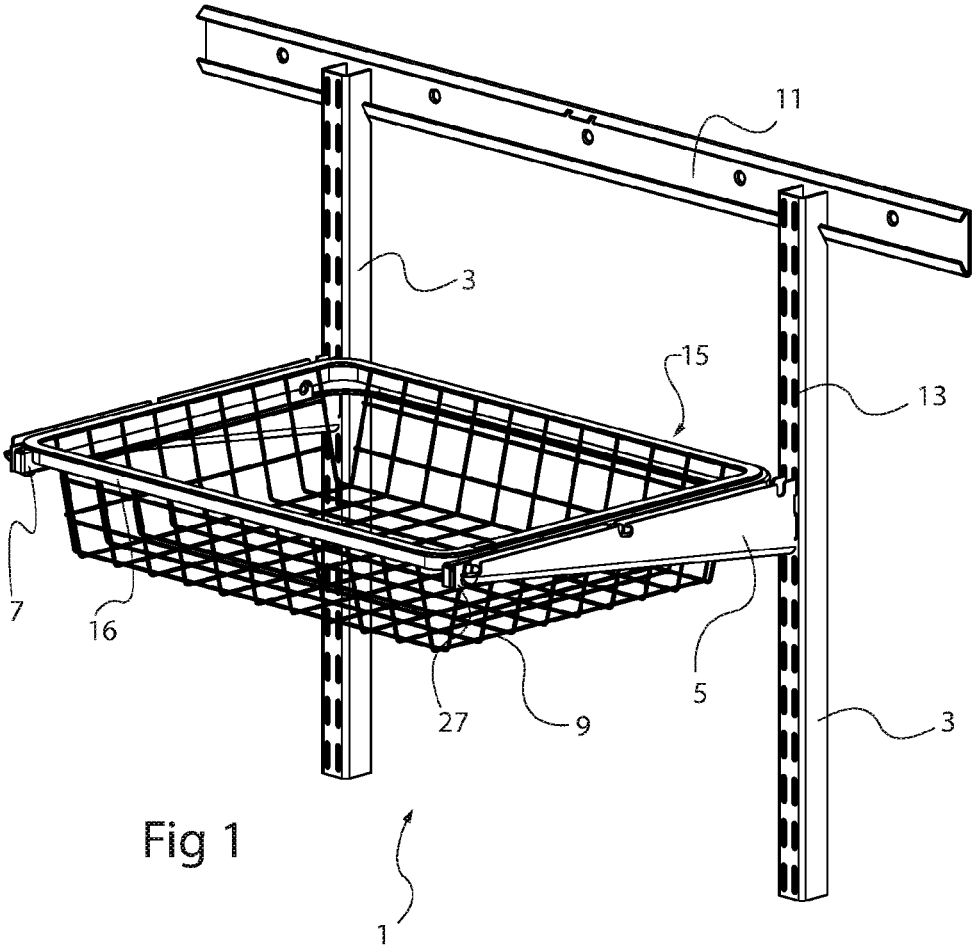
FIG. 1 shows a perspective view of a suspension system according to the present disclosure where a wire basket is suspended in a frame.

FIG. 1 illustrates a suspension system 1, which may comprise supporting elements or rails 3, a pair of brackets 5 attached to the elements, a partially slidable frame 7, 15, 16, 27, attached on the brackets 5, and optionally a holding device in the form of a container, for instance a wire basket 9, fitted in the frame 7, 15, 16, 27.

The supporting elements 3 are vertically oriented and are attached to a vertical surface such as a wall, or connected to a set of feet resting on a floor. If, as illustrated in FIG. 1, the supporting elements 3 are attached to a wall, they may be attached to an optional horizontal bar 11 which is attached to the wall as well, as is well known per se.

Each supporting element 3 may be formed as an in cross-section U-shaped rail, which is attached to the wall by means of screws, with the legs of the "U" directed towards the wall. The supporting elements 3 may be made from sheet metal. The supporting elements 3 may be provided with two parallel rows of slots 13 in the portion connecting the legs as is well known per se. In principle, the supporting elements 3 could be provided e.g. with only one row of slots 13. It would also be possible to device the rail also e.g. as a tube with rectangular cross section having slots at a face thereof.

The brackets 5, which may be made from sheet metal as well, are adapted to be used in pairs which detachably carry a shelf or a wire drawer, or the like. The brackets are suspended from a respective supporting element 3, using hook-shaped, protruding portions which are inserted into selected slots 13 in the supporting element 3 to engage with the supporting element for suspension of the bracket therefrom in a cantilevered fashion, as is well known per se.

The brackets may be made of sheet metal bent in a U-shape in cross-section, with the legs of the "U" directed upwards. As illustrated, the brackets may be tapering in the direction away from the support element, such that the depth of the "U" decreases towards the cantilevered end of the bracket 5. The upper edge of the bracket 5 remains substantially horizontal along the length of the bracket when attached to a support element/carrier.

Figure 11:
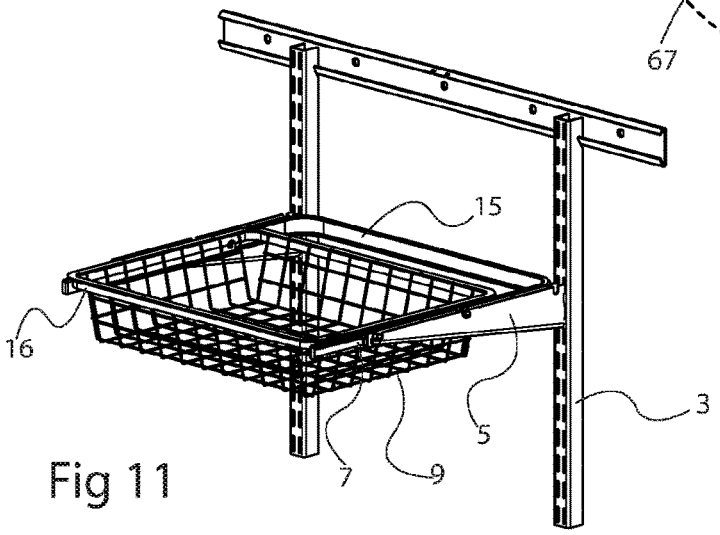
FIG. 11 shows the suspension system of FIG. 1 where the wire basket and the guided part of the frame are partly slid out of the area in between the brackets.

As described in the aforementioned document U.S. Pat. No. 7,104,411 B2, in addition to suspending a shelf on the brackets, a frame 7, 15, 16, 27 may be attached to the brackets 5. The frame may comprise a slidable portion 7, 16 as well as two side portions 27 that are fixed to the brackets. In the illustrated example, an optional interconnecting rear portion 15, connects the fixed side portions 27 together forming a "U", the opening of which faces away from the wall. A rectangular container frame 16 may be carried by the slidable side portions 7. The slidable portions of the frame 7 are slidable by means of guides in the fixed side portions 27, such that they can be at least partly slid out of the area in between the brackets. A container such as a wire basket 9 can be fitted in the slidable part of the frame, typically by being suspended in the rectangular container frame 16. If slid out, as shown in FIG. 11, the contents of the container 9 becomes accessible, even if e.g. a shelf is located directly on top of the container, suspended by separate brackets.

A fixed part of the frame 27 at each side is thus attached to a respective bracket 5, while an inner part 7 at each side is slidable with regard to its respective fixed part.

The present disclosure relates to an improved way of attaching these fixed outer parts 27 of the side portions to the brackets 5.

Figure 2:
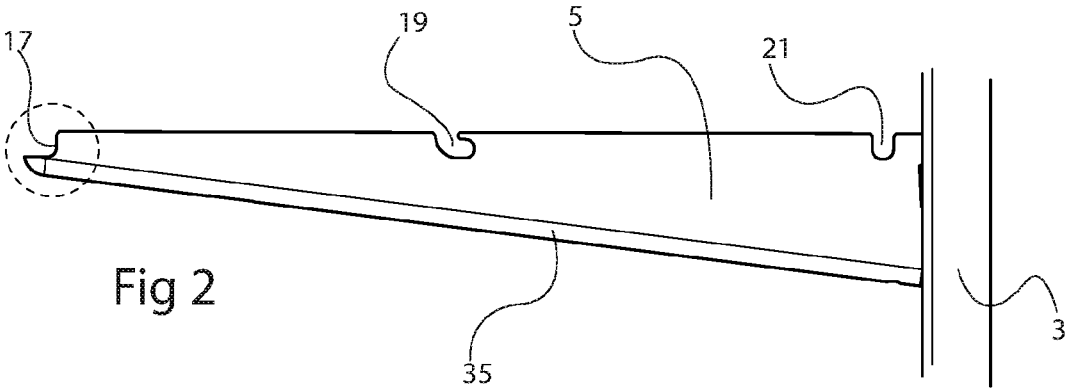
FIG. 2 shows a side view of a bracket attached to a carrier.

FIG. 2 shows a side view of a bracket 5 attached to a carrier 3. The bracket 5 may be symmetrical across a vertical plane through the centre of its longitudinal extension, such that it has equal possibilities to attach frames or shelves at both lateral sides. In order to allow frames of the aforementioned type to be attached to the bracket 5, the bracket includes a punched front cut-out 17 at each side, and an L-shaped cut-out 19 in the upper portion of the mid-section, typically in the mid third along the length of the bracket 5, of the bracket at each side. Such cut-outs are known per se from the aforementioned document. Additionally, a rear locking cut-out 21 is illustrated which may be used in some applications to prevent the bracket 5 from being released from the carrier 3, although this is not used in the presently disclosed example.

FIG. 3 shows the side view of FIG. 2 when a side portion of a frame is attached to the bracket, FIGS. 4 and 5 show enlarged portions of FIG. 3, and FIG. 6 shows a front view of the bracket attached to a carrier and wherein a frame is attached to the bracket, as seen from the front end of the bracket.

With reference to FIGS. 3-6, FIG. 4 shows an enlarged portion of the mid-section of the bracket 5. In this section, a tongue 23 of the fixed part side portions 27 of the frame engages with the L-shaped cut-out 19, to clasp the edge or rim of this cut-out. At the same time, when fully attached, a protruding bulb 25 of the fixed part side portions 27 snaps into the L-shaped cut-out 19, with a steeply inclined part of the bulb 25 facing the rear 29 of the L-shaped cut-out 19, such that the fixed part side portions 27 of the frame is locked and firmly attached to the bracket 5. The tongue 23 in the mid-section is partly obscured by the half of the bracket adjacent to the viewer, as indicated with dashed lines, but it should be noted that the bracket 5 is symmetrical in the illustrated example, and that the L-shaped cut-out 19 of the distant side of the bracket thus has the same extension as the one of the adjacent side.

FIG. 5 shows the front part or the cantilevered part of the bracket 5 with a front tongue 31 of the frame fixed part side portions 27 engaging with the front cut-out 17 of the bracket 5 in the same way as the mid-section tongue 23. Additionally, a support tongue 33 of the fixed part side portions 27 extends out of the plane thereof and partly reaches under the lower bent part 35 of the bracket 5, as is most clearly shown in the front view of FIG. 6. The lower bent part 35 is also indicated in FIG. 2. As illustrated in FIG. 6, the support tongue 33 abuts the lower portion of the bracket at the interconnecting bend portion at a point on the bent portion located at the same lateral half of the bracket as the front cut-out, such that there is room for a similar arrangement on the other lateral side of the bracket.

FIG. 6 also shows a wheel 39 attached to the fixed part side portions 27 of the frame. An inner slidable part 7 of the frame is guided with respect to the fixed part side portions 27 by means inter alia of the wheel 39 as is known per se. FIG. 6 further shows the slots 13 of the supporting elements 3, into which hooks of the bracket are inserted.

As shown in FIG. 5, a nose part 37 of the bracket 5 becomes wedged between the front tongue 31 and the support tongue 33 of the frame fixed part side portions 27. This means that these two tongues 31, 33, together with the mid-section tongue 23 is enough to support the frame at this bracket 5. The mid-section tongue 23 will likely take up a greater part of the load when the container is pushed in, although this depends on how the attached container 9 (cf. FIG. 1) is loaded. When the drawer is pulled out a greater part of the load is applied on the upper front tongue. The front tongue 31 and the support tongue 33 eliminates pivoting of the frame and the container on the mid-section tongue 23 either forwards (the front tongue 31) or backwards (the support tongue 33). As the front tongue 31 and the support tongue 33 are located relatively close to each other, the manufacturing tolerances as regards their mutual distance can be kept small. The wedging of the nose part 37 can therefore substantially eliminate play in the attachment of the frame to the bracket in a convenient way. This wedging function is further described with reference to FIGS. 7-9.

Figure 8:
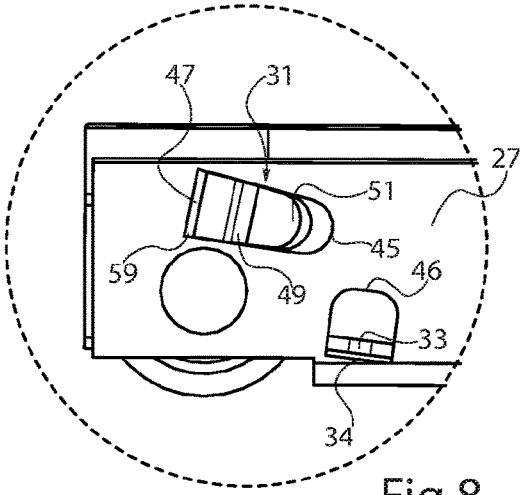
FIG. 8 shows an enlarged portion of the front end of the frame in FIG. 7.
Figure 9:
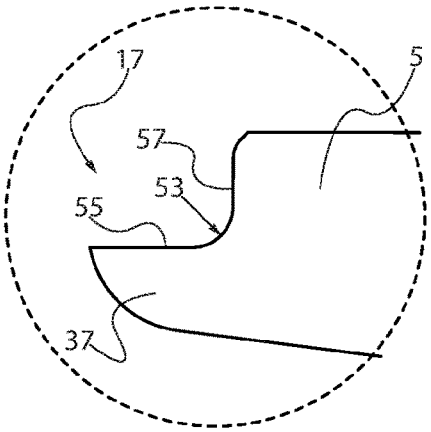
FIG. 9 shows an enlarged portion of the front end of the bracket in FIG. 2.

FIG. 7 shows a side view of a frame side portion, and FIG. 8 shows an enlarged portion of the front end thereof. FIG. 9 shows an enlarged portion of the front end of the bracket in FIG. 2. As can be seen in FIG. 8, the front tongue 31 can be punched out of fixed part side portions 27 of the frame, thereby creating an opening 45 in the fixed part. The front tongue is then bent at its attachment line 47, i.e. where it is folded out of the fixed part side portions 27, to create a parallel offset portion 49 with regard to the fixed part, as can also be seen in FIG. 6. This is the part of the tongue that will clasp the bracket, when attached thereto. The tip of the tongue 51 may be bent further outwards in order to make it simpler to attach the tongue to the bracket. The support tongue 33 may be punched from the fixed part side portions 27, creating another opening 46, and then simply bent to be more or less perpendicular to the plane of the fixed part side portions 27, the attachment line 34 of the tongue 33 being almost hidden behind the tongue in FIG. 8 as the latter is substantially perpendicular to the plane from which it is punched out.

FIG. 9 shows a front part of the bracket 5, where the front cut-out 17, formed by punching, comprises a rear vertical portion 57, a front horizontal portion 55 and a radius 53 in between the vertical and horizontal portions. When the front tongue 31 is arranged to clasp the bracket at the front cut-out 17, the lower edge 59 of the front tongue close to the attachment line 47 will support the fixed part by resting on the bracket at a location of the transition between the front horizontal portion 55 and the radius 53. The support tongue 33, may therefore be very gently urged downwards by the wedging as the fixed part is pushed in until the point where the bulb 25 snaps into the L-shaped cut-out 19 at the mid-section of the bracket 5 and the fixed part becomes locked thereto. This allows either a very small play or no play and a gentle resistance from wedging the nose part 37 of the bracket between the front tongue 31 and the support tongue 33, even if the tolerances are comparatively larger with regard to the locations of the front cut-out 17 and the L-shaped cut-out 19 on the bracket on the one hand and the locations of the front tongue 31, the support tongue 33, and the bulb 25 on the fixed part of the frame on the other.

Figure 10:
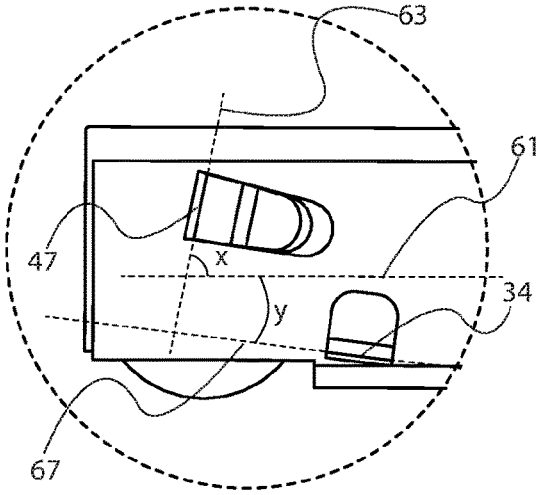
FIG. 10 corresponds to FIG. 8 with some details suppressed in order to clarify the geometry of features of the frame.

FIG. 10 corresponds to FIG. 8 with some details suppressed in order to clarify the geometry of features of the frame. Angles are indicated with reference to the longitudinal direction 61 of the fixed part of the frame side portions 27 as a whole, that is the direction in which the frame is pulled out of the area in between the brackets.

The front tongue has an attachment line 47, where it is connected to the fixed part of the frame side portions 27, which extends in a direction 63 forming an acute angle x, typically in the range between 75-82 degrees, with the longitudinal direction 61 of the frame. Thereby, the front tongue 31 is directed to the rear, but slightly downwards. The support tongue has an attachment line 34, where it is connected to the fixed part of the frame, with a direction 67 forming an angle y in the range 5-9 degrees with the longitudinal direction 61 of the frame such that the top surface of the support tongue 33 slants slightly to the rear.

The present disclosure is not restricted to the examples given above, and may be varied and altered in different ways within the scope of the appended claims. For instance, instead of a container such as a wire basket, a mesh basket, a plastic box, a holding device including hooks or the like may be fitted in the drawer frame.

The invention claimed is:

1. A suspension system comprising:

first and second support elements configured to be vertically arranged, first and second brackets, each configured to be attached to a respective one of the support elements in a cantilevered fashion having a U-shaped cross-section with first and second leg portions and an interconnecting lower bend portion, and a frame comprising side portions each configured to be attached to a respective one of the brackets with a fastening arrangement, a guided part of the frame being slideable in and out of an area in between the brackets and comprising a holding device;

wherein the fastening arrangement comprises:

a mid-section attachment device including a center cut-out in the mid third of the bracket and in a leg portion thereof, an attachment tongue on the side portion, which is configured to be inserted into the center cut-out to clasp the edge thereof, and a bulb adapted to snap into the centre cut-out, and a front attachment device including a front cut-out in the cantilevered end of the bracket, in said leg portion thereof, a front attachment tongue on the side portion, which is configured to be inserted into the front cut-out to clasp the edge thereof, and a support tongue configured to abut the lower portion of the bracket, such that a nose portion of the bracket is wedged in between the front attachment tongue and the support tongue.

2. A suspension system according to claim 1, wherein the front cut-out comprises a rear vertical portion, a front horizontal portion and a radius in between the vertical and horizontal portions.

3. A suspension system according to claim 2, wherein the front attachment tongue rests on the front cut-out at the transition between the horizontal portion and the radius when the frame is attached to the bracket.

4. A suspension system according to claim 1, wherein the support tongue is configured to abut the lower portion of the bracket at the interconnecting bend portion at a point on the bend portion located at the same lateral half of the bracket as the front cut-out.

5. A suspension system according to claim 1, wherein the front tongue has an attachment line, where it is connected to the fixed part of the frame, wherein the attachment line forms an acute angle (x) in the range 75-82 degrees with the longitudinal direction of the frame.

6. A suspension system according to claim 1, wherein the support tongue has an attachment line, where it is connected to the fixed part of the frame, wherein the attachment line forms an angle (y) in the range 5-9 degrees with the longitudinal direction of the frame.

7. A suspension system comprising:

first and second support elements configured to be vertically arranged;

first and second brackets, each configured to be attached to a respective one of the support elements in a cantilevered fashion and having a U-shaped cross-section with first and second leg portions and an interconnecting lower bend portion; and a frame comprising side portions each configured to be attached to a respective one of the brackets with a fastening arrangement, a guided part of the frame being slideable in and out of an area in between the brackets and comprising a holding device;

wherein the fastening arrangement comprises:

a mid-section attachment device including a center cut-out in the mid third of the bracket and in a leg portion thereof, an attachment tongue on the side portion, which is configured to be inserted into the centre cut-out to clasp the edge thereof, and a bulb adapted to snap into the centre cut-out, and a front attachment device including a front cut-out in the cantilevered end of the bracket, in said leg portion thereof, a front attachment tongue on the side portion, which is configured to be inserted into the front cut-out to clasp the edge thereof, and a support tongue configured to abut the lower portion of the bracket, such that a nose portion of the bracket is wedged in between the front attachment tongue and the support tongue, the front cut-out comprising a rear vertical portion a front horizontal portion and a radius in between the vertical and horizontal portions.

8. A suspension system according to claim 7, wherein the support tongue is configured to abut the lower portion of the bracket at the interconnecting bend portion at a point on the bend portion located at the same lateral half of the bracket as the front cut-out.

9. A suspension system according to claim 7, wherein the front tongue has an attachment line, where it is connected to the fixed part of the frame, wherein the attachment line forms an acute angle (x) in the range 75-82 degrees with the longitudinal direction of the frame.

10. A suspension system according to claim 7, wherein the support tongue has an attachment line, where it is connected to the fixed part of the frame, wherein the attachment line forms an angle (y) in the range 5-9 degrees with the longitudinal direction of the frame.

11. A suspension system comprising:

first and second support elements configured to be vertically arranged;

first and second brackets, each configured to be attached to a respective one of the support elements in a cantilevered fashion and having a U-shaped cross-section with first and second leg portions and an interconnecting lower bend portion; and a frame comprising side portions each configured to be attached to a respective one of the brackets with a fastening arrangement, a guided part of the frame being slideable in and out of an area in between the brackets and comprising a holding device;

wherein the fastening arrangement comprises:

a mid-section attachment device including a center cut-out in the mid third of the bracket and in a leg portion thereof, an attachment tongue on the side portion, which is configured to be inserted into the centre cut-out to clasp the edge thereof, and a bulb adapted to snap into the centre cut-out, and a front attachment device including a front cut-out in the cantilevered end of the bracket, in said leg portion thereof, a front attachment tongue on the side portion, which is configured to be inserted into the front cut-out to clasp the edge thereof, and a support tongue configured to abut the lower portion of the bracket, such that a nose portion of the bracket is wedged in between the front attachment tongue and the support tongue, the support tongue being configured to abut the lower portion of the bracket at the interconnecting bend portion at a point on the bend portion located at the same lateral half of the bracket as the front cut-out.

12. A suspension system according to claim 11, wherein the front cut-out comprises a rear vertical portion, a front horizontal portion and a radius in between the vertical and horizontal portions.

13. A suspension system according to claim 12, wherein the front attachment tongue rests on the front cut-out at the transition between the horizontal portion and the radius when the frame is attached to the bracket.

14. A suspension system according to claim 7, wherein the front tongue has an attachment line, where it is connected to the fixed part of the frame, wherein the attachment line forms an acute angle (x) in the range 75-82 degrees with the longitudinal direction of the frame.

15. A suspension system according to claim 7, wherein the support tongue has an attachment line, where it is connected to the fixed part of the frame, wherein the attachment line forms an angle (y) in the range 5-9 degrees with the longitudinal direction of the frame.

* * * * *